US008814282B2

(12) United States Patent
Halfon et al.

(10) Patent No.: US 8,814,282 B2
(45) Date of Patent: Aug. 26, 2014

(54) SYSTEM OF EJECTING A SLIDING DOOR

(75) Inventors: Amos Halfon, Sitriya (IL); Mordechai Harari, Rishon LeZion (IL)

(73) Assignee: Hardoor Top Design & Technology Ltd., Rishon-Lezion (IL)

( * ) Notice: Subject to any disclaimer, the term of this patent is extended or adjusted under 35 U.S.C. 154(b) by 0 days.

(21) Appl. No.: 13/810,941

(22) PCT Filed: Jul. 19, 2011

(86) PCT No.: PCT/IL2011/000572

§ 371 (c)(1),
(2), (4) Date: Jan. 18, 2013

(87) PCT Pub. No.: WO2012/011099

PCT Pub. Date: Jan. 26, 2012

(65) Prior Publication Data

US 2013/0118086 A1 May 16, 2013

Related U.S. Application Data

(60) Provisional application No. 61/365,431, filed on Jul. 19, 2010.

(51) Int. Cl.
*A47F 3/00* (2006.01)

(52) U.S. Cl.
USPC ..... 312/139.1; 312/109; 49/211; 49/216; 49/220

(58) Field of Classification Search
USPC ..... 49/209, 210, 211, 216, 218, 219, 220, 49/221, 223; 312/109, 138.1, 139.1, 312/139.2, 300, 309, 310, 312, 325, 326
See application file for complete search history.

(56) References Cited

U.S. PATENT DOCUMENTS

| | | | | |
|---|---|---|---|---|
| 3,660,938 | A * | 5/1972 | Ross et al. | 49/220 |
| 3,797,170 | A * | 3/1974 | Lemon | 49/220 |
| 3,885,349 | A * | 5/1975 | Owen | 49/220 |
| 4,028,850 | A | 6/1977 | Marzocco | |
| 4,064,810 | A * | 12/1977 | Jenkins et al. | 105/378 |
| 4,662,110 | A * | 5/1987 | Rokicki | 49/220 |
| 4,691,474 | A * | 9/1987 | Rokicki | 49/220 |
| 4,726,145 | A * | 2/1988 | Rokicki | 49/220 |
| 5,271,181 | A | 12/1993 | Pietro | |
| 5,483,769 | A * | 1/1996 | Zweili | 49/118 |
| 5,735,080 | A * | 4/1998 | Pratolongo | 49/209 |
| 6,546,611 | B1 * | 4/2003 | Ryan | 29/401.1 |
| 6,647,896 | B1 * | 11/2003 | Nottingham et al. | 105/378 |
| 8,070,102 | B2 * | 12/2011 | Kobayashi et al. | 244/129.5 |
| 2003/0141415 | A1 | 7/2003 | Leclerc | |
| 2005/0183236 | A1 | 8/2005 | Wichman et al. | |
| 2008/0222957 | A1 | 9/2008 | Bienek | |

OTHER PUBLICATIONS

International Search Report and Written Opinion dated Dec. 23, 2011 in corresponding International Application No. PCT/IL2011/000572.

* cited by examiner

*Primary Examiner* — Jerry Redman
(74) *Attorney, Agent, or Firm* — Browdy and Neimark, PLLC

(57) ABSTRACT

A system of ejecting a sliding door of a closet, comprising a plurality of ejection assemblies and a connecting mechanism, which connects one assembly to the other. Each ejection assembly comprises a rail and a slidable member configured to slide along the rail, where the rail engages with a frame of the closet. The connecting mechanism allows synchronizing the ejection force applied upon the door at different locations of the door, by connecting the ejection assemblies through the connecting mechanism. This configuration allows ejecting and retrieving of the door outwardly and inwardly by sliding the slidable member of each assembly along the rail.

19 Claims, 14 Drawing Sheets

SYSTEM OF EJECTING A SLIDING DOOR

CROSS-REFERENCE TO RELATED PATENT APPLICATIONS

This application is a national phase of PCT/IL11/00572 filed on Jul. 19, 2011, which claimed priority to Provisional patent application No. 61/365,431 filed on Jul. 19, 2010, which is incorporated herein by reference in its entirety.

FIELD OF THE INVENTION

The present invention generally relates to sliding doors systems and more particularly to systems for moving sliding doors.

DISCUSSION OF RELATED ART

Sliding doors are commonly used in closets and compartments and make an easy and esthetic solution for opening and closing of closet doors. Sliding doors are usually connected to rollers or sliding members that can slide along upper and lower tracks installed at the closet lower and upper frame.

Since each track length is confined to the width of the closet, and since more than one sliding door is required for covering the open side of the closet, each doors usually slides along a different upper track and a different lower track where of the lower tracks and the upper tracks are located at a predefined distance from one another allowing the doors to slide through one another when opening or closing a section of the closet. This means that each door is installed at a different plane where the planes of the doors are parallel.

To allow the sliding doors to be installed at the same plane when the closet is closed, at least one of the doors must be movable outwardly when opening the door to allow sliding of one of the doors along the track. Otherwise, the doors will block one another from sliding along the tracks.

SUMMARY

According to one aspect of the invention, there is provided a system of moving a sliding door of a closet. The system may comprise at least two ejection assemblies and at least one connecting mechanism, which connects one assembly to the other, where the ejection assemblies enable moving of the door.

According to some embodiments of the present invention, each ejection assembly may comprise a rail and a slidable member configured to slide along the rail, where the rail is operatively connected to the door. The connecting mechanism may allow applying a simultaneous force upon the door at different locations of the door, allowing synchronizing the mechanical moving of all ejection assemblies by connecting them to one another.

The rail in each assembly engages with the frame of the closet, where the assembly is connected to the door. This configuration allows moving the door outwardly from the closet frame by sliding the slidable member towards the distal end of the door, and retrieving the door inwardly by sliding the slidable member towards a proximal end of the door. Since the rails engage with the closet frame, the entire door is moved upon movement of the slidable members of the assemblies in relation to their rails. Each of the ejection assemblies enables simultaneously moving the door outwardly and inwardly from a plane that is substantially parallel to the door thereby enabling synchronized moving at a plurality of locations of the door.

According to some embodiments of the present invention, the connecting mechanism may include a set of connectors such as rods operatively associated with the door handle thereby enabling simultaneously operating all ejection assemblies by a single rotation of the handle.

Alternatively, the connecting mechanism may include a hydraulic or pneumatic system including a pump and a tube set, where each of the ejection assemblies includes a piston connected to the pump. The piston may be connected to the slidable member thereby enabling moving the piston in and out to allow sliding the slidable member along rail to move the door forwardly or inwardly.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings (Figures, or simply "FIGS."), wherein.

DETAILED DESCRIPTION

Figure 1:
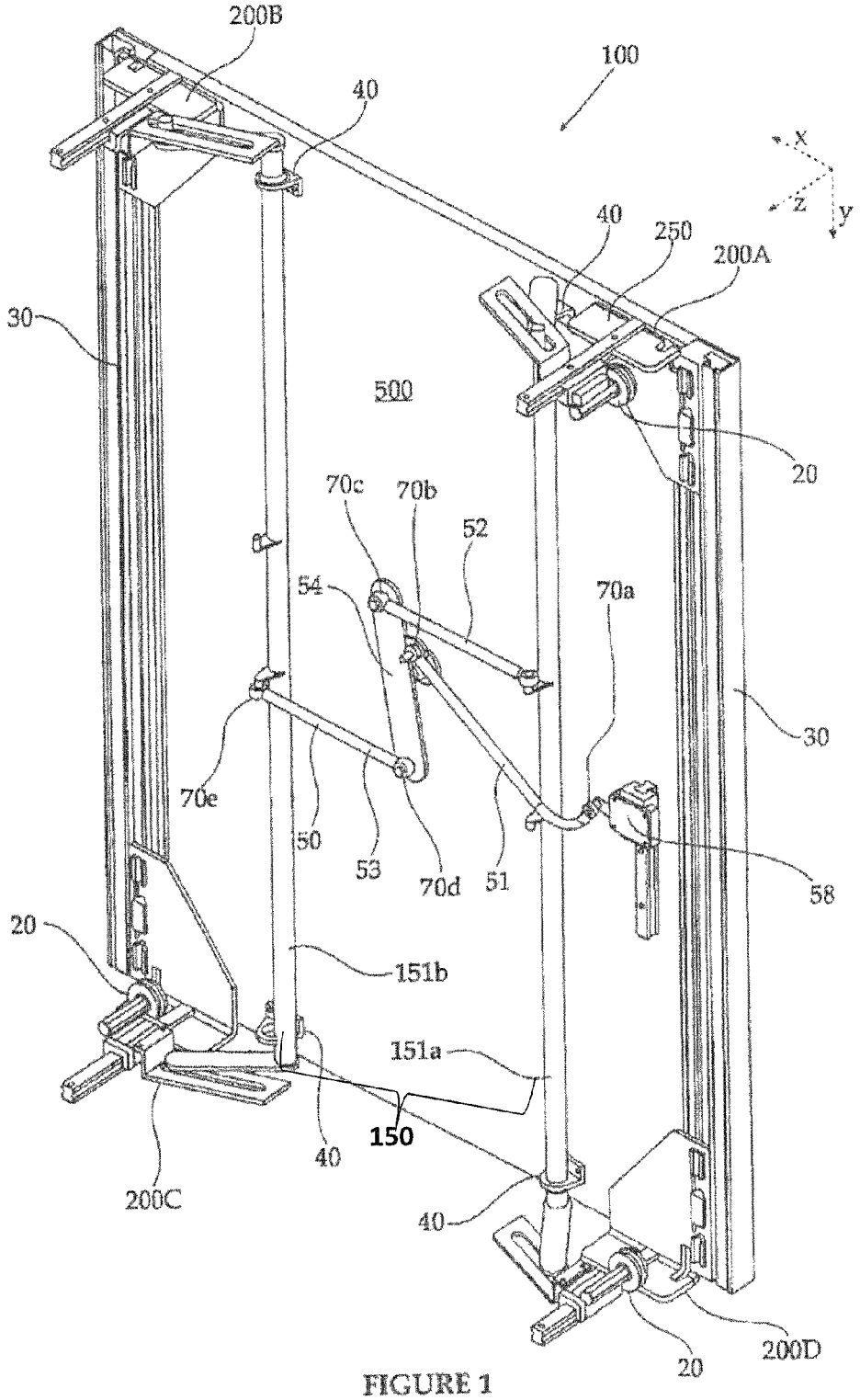
FIG. 1 is an isometric view of a system for moving a sliding door of a closet, having a rod-set connecting mechanism, according to some embodiments of the present invention.

The present invention, in some embodiments thereof, provides systems of ejecting a sliding door of a closet. Each system may comprise a plurality of ejection assemblies and a connecting mechanism, which connects one assembly to the other, where the ejection assemblies enable ejecting of the door.

According to some embodiments of the present invention, each ejection assembly comprises a rail and a slidable member configured to slide along the rail. The assembly is connected to the door. The connecting mechanism may allow applying simultaneous push or pull forces upon the door at different locations of the door, allowing synchronizing the mechanical movement of all ejection assemblies by connecting them to one another.

The rail in each assembly engages with the frame of the closet, where the assembly is connected to the door. This configuration allows moving the door outwardly from the closet frame by sliding the slidable member towards the distal end of the door, and retrieving the door inwardly by sliding the slidable member towards a proximal end of the door. Since the rails engage with the closet frame, the entire door is moved outwardly upon simultaneous movement of the slidable members of the assemblies in relation to their rails, thereby enabling synchronized pushing or pulling at a plurality of locations of the door.

According to some embodiments of the present invention, the connecting mechanism may include a set of connectors such as rods operatively associated with the door handle thereby enabling simultaneously operating all ejection assemblies by a single rotation of the handle.

Alternatively, the connecting mechanism may include a hydraulic or pneumatic system including a pump and a tube set, where each of the ejection assemblies includes a piston connected to the pump. The piston may be connected to the slidable member thereby enabling moving the piston in and out to allow sliding the slidable member along rail to eject or retrieve the door.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. In other modules, well-known methods, procedures, components and circuits have not been described in detail so as not to obscure the teachings of the present disclosure.

Reference is now made to FIG. 1, which schematically illustrate a system 100 for ejecting a sliding door 500, according to some embodiments of the present invention. The system 100 may comprises four ejection assemblies 200 each connected at a different corner of the door 500 through a connecting member 250. The ejection assemblies 200 are connected to one another through a connecting mechanism 150.

Figure 2:
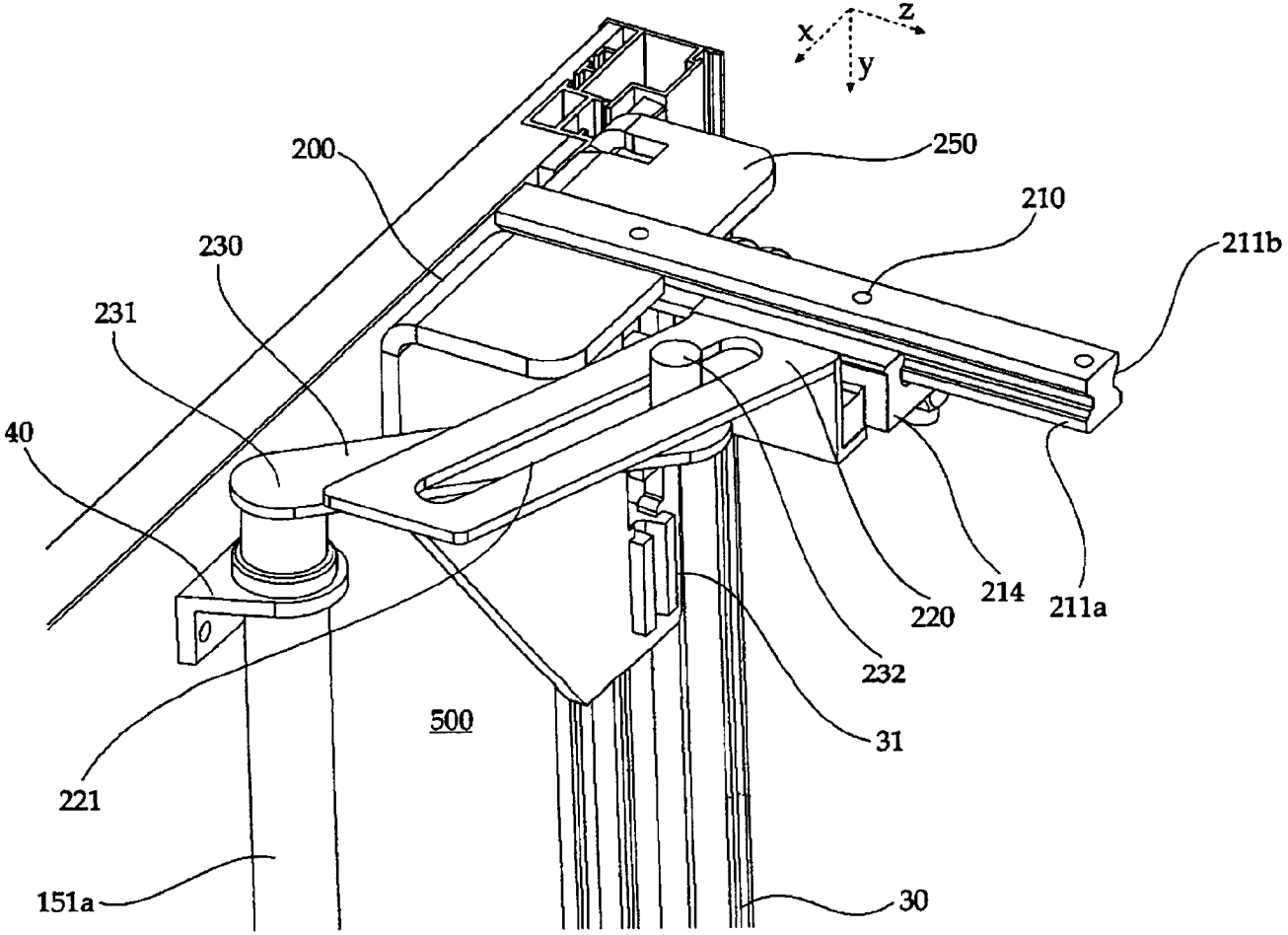
FIG. 2 schematically illustrates an ejection assembly of the system at a retrieved position installed at a sliding door, according to embodiments of the present invention as illustrated in FIG. 1.
Figure 3:
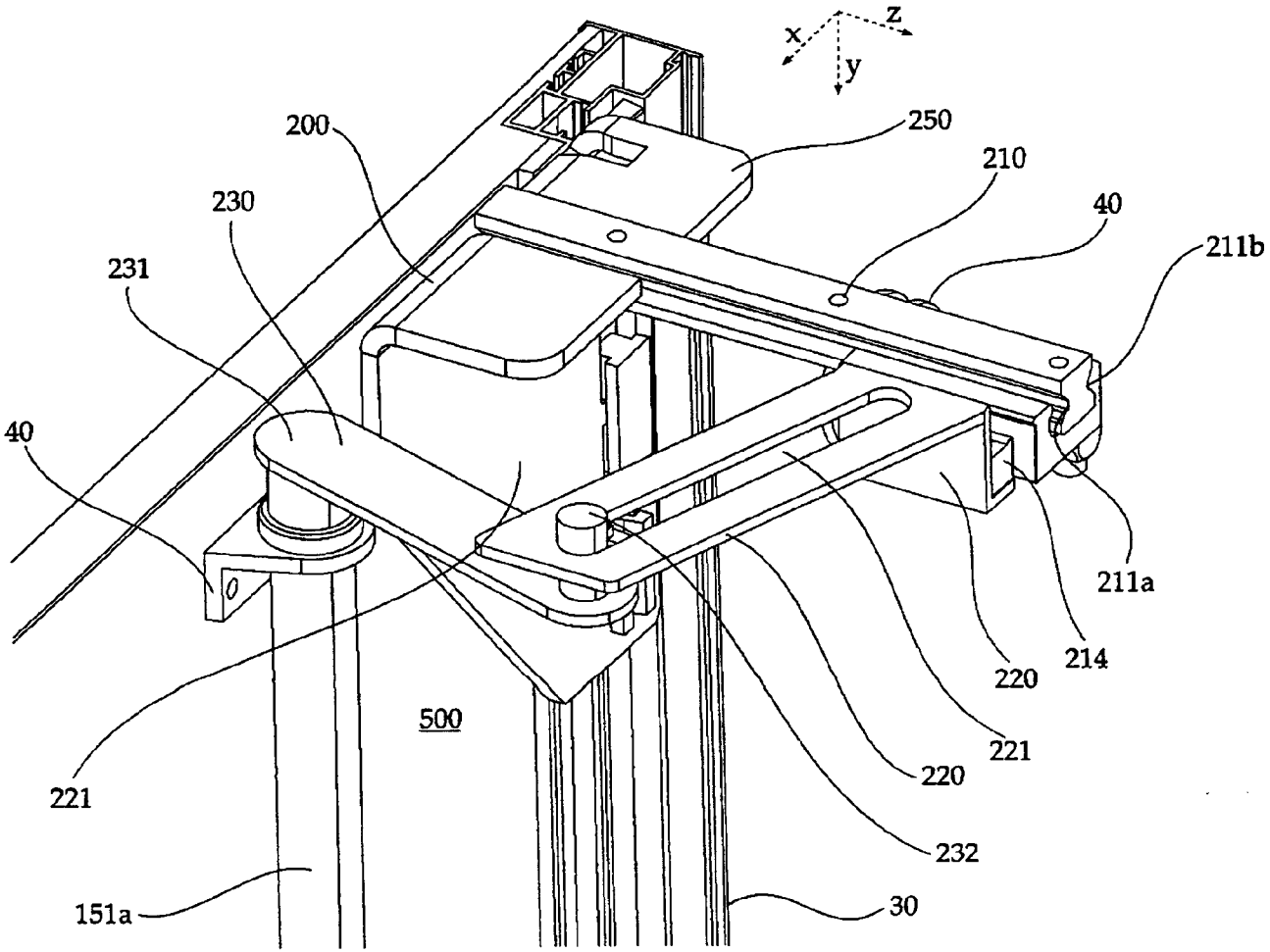
FIG. 3 schematically illustrates an ejection assembly of the system at an ejected position installed at a sliding door, according to embodiments of the present invention as illustrated in FIG. 1.
Figure 4:
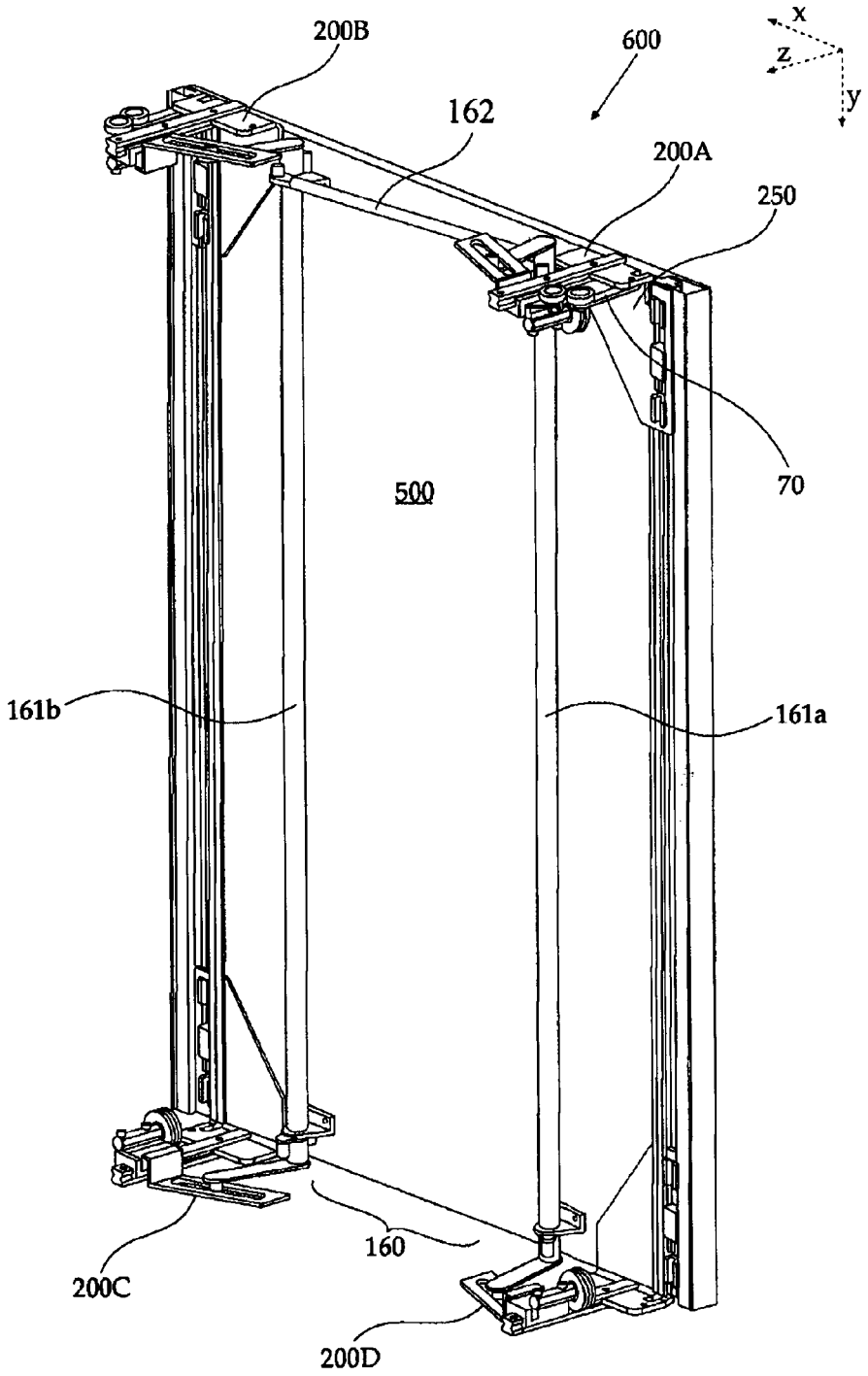
FIG. 4 is an isometric view of a system for ejecting a sliding door of a closet, having mode fixation mechanism, according to some embodiments of the present invention.

As illustrated in FIGS. 1-3, each ejection assembly 200 comprises a rail 210 and a slidable member 214 configured to slide along the rail 210.

The ejection assembly 200 further comprises a connector 220, fastened to the slidable member 214 at one end through fastening means. The connector 220 includes a groove 221, which may be an opening enabling to receive a protrusion 232 of an interlocking member 230. The protrusion 232 is configured to movably interlock into the groove 221. The movable member 231 is connected to the connecting mechanism 150. This configuration, as illustrated in FIGS. 2-3, allows sliding the slidable member 214 along the rail 210 upon moving of the protrusion 232 along the groove 221. The protrusion 232 is moved along the groove 221 upon movement of the connecting mechanism 150, which operatively connects to the door handle (not shown). Therefore, a turning or rotating of the door handle allows sliding the protrusion 232 along the groove 221 and thereby allows sliding the slidable member 214 along the rail 210.

Alternatively, the ejection assemblies 200 and/or the connecting mechanism 150 may be operatively associated with at least one motor and an electronic control panel (whether remote or installed at the door 500) enabling to eject and retrieve the door 500 by controlling the motor. The motor may be operatively associated with one or more slidable members 214 allowing sliding thereof.

As illustrated in FIGS. 1-3, the ejection assembly 200 further includes a roller 20, configured to slide along a track of the closet along an axis "x". The roller 20 is fastened to the slidable member 214 through any fastening means known in the art. The rolling direction of said roller 20 along the door track is angular to the sliding direction of the slidable member 214 along the rail 210. The sliding direction of the slidable member 214, as illustrated in FIGS. 1-3, is along an axis "z" perpendicular to "x" the sliding direction of the door 500. The sliding direction of the protrusion 232 along the groove 221 is angular to the sliding direction of the slidable member 214 and also to the sliding direction of the sliding door 500.

Once the door 500 is in an ejected position, in which the door is moved outwardly, as illustrated in FIG. 3, the slidable member 214 is located at a distal end in relation to the door 500 and the protrusion 232 is located at a distal end in relation to the rail 210. In a closed position, in which the door is retrieved inwardly, as illustrated in FIG. 2, the slidable member 214 is located at a proximal end in relation to the door 500 and the protrusion 232 is located at a proximal end in relation to the rail 210.

According to some embodiments of the present invention, as illustrated in FIG. 1, the connecting mechanism 150 comprises a first rod 151A connecting two ejection assemblies located at two corners at a first side of the door 500 and a second rod 151B connecting two other ejection assemblies located at two other corners at a second side of the door 500. The connecting mechanism 150 further includes a rod-connecting assembly 50 for connecting the first rod 151A to the second rod 151B and for connecting to the door handle.

As illustrated in FIG. 1, the rod-connecting assembly 50 may comprise a first connector 51, a second connector 52, a third connector 53 and a main axle 54. The first connector 51 pivotally connects to the main axle 54 at one end ant to the door 500 at another end. The second connector 52 pivotally connects to the main axle 54 at one end ant to the first rod 151A at another end. The third connector 53 pivotally connects to the main axle 54 at one end ant to the second rod 151B at another end. Since the first connector 51 connects to the door handle and to the main axle 54, it allows moving the axle 54 upon movement of the first connector 51, thereby allowing synchronized movement of the first, second and third connectors 51-53 upon manual rotation of the door handle.

The connecting mechanism 150 of each of the ejection assemblies 200 may further connect to the door 500 via at least one bracket 40, which may be a bearing or any other mechanism enabling movement of the rods with minimal friction.

According to some embodiments of the present invention, the door 500 is attached to profiles 30 framing the door at each side. The connecting member 250 of each ejection assembly 200 may be attached to one of the profiles 30 at the corner in which the ejection assembly 200 is installed, as illustrated in FIGS. 1-3.

To attach to the profile 30 the connecting member 250 may include protruding members 31 interlocking with corresponding openings at the profile 30.

Reference is now made to FIGS. 4, 5A, 5B, and 5C, which schematically illustrate an ejection system 600, having ejection assemblies 200A, 200B, 200C and 200D which are similar to the assemblies as described in reference to FIGS. 1-3. The system 600 additionally includes a different connecting mechanism 160 which connects to the door 500 and to each of the ejection assemblies 200A, 200B, 200C and 200D. The connecting mechanism 160 includes two rods 161A and 161B each rod connects to two different ejection assemblies: the rod 161A connects ejection assemblies 200A and 200D which are located at one side of the door 500 and the rod 161B connects ejection assemblies 200B and 200C which are located at another side of the door 500. The connecting mechanism 160 additionally includes a connector 162 which connects the two rods 161A and 161B as well the two upper ejection assemblies 200A and 200B.

Figure 5A:
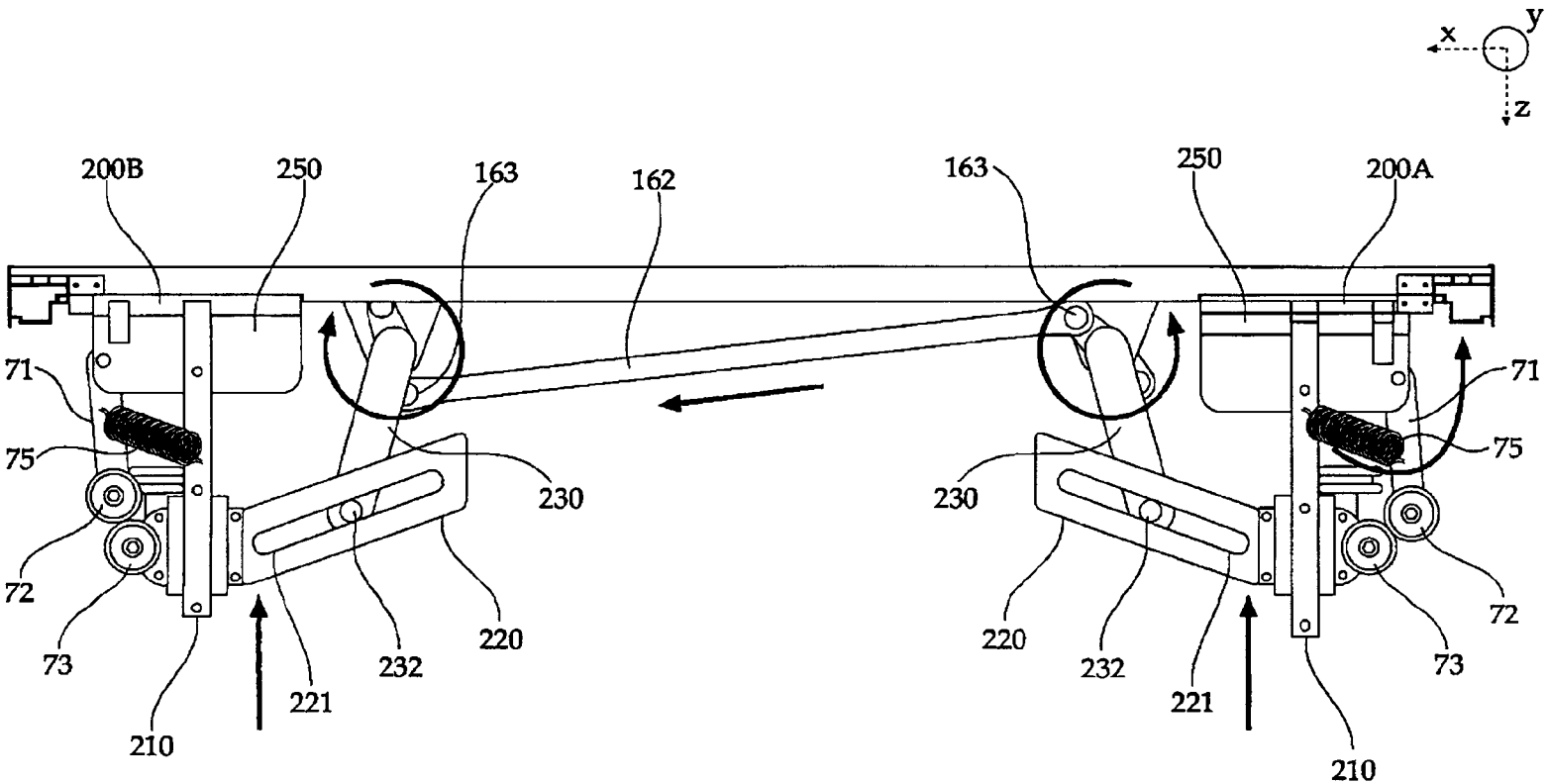
FIG. 5A schematically illustrates two ejection assemblies of the system at an ejected position installed at a sliding door each having mode fixation assembly, according to embodiments of the present invention as illustrated in FIG. 4.

As illustrated in FIG. 5A, the connector 162 pivotally connects to the interlocking member 230 of each ejection assembly 200A and 200B at each side of the connector 162. The connector 162 connects to a proximal end of the interlocking member 230 of ejection assembly 200A and to a distal end of the interlocking member 230 of the other ejection assembly 200B, thereby always positioned at an angle that is neither perpendicular nor parallel to the "x" axis of the door plane. The angular positioning of connector 162 provides an optimal leverage for ejecting the door 500 once a user pushes the door 500 outwardly for ejection thereof. In addition, the angular position of the connector 162 allows rotating one rod such as rod 161A in one rotation direction, while simultaneously rotating the other rod 161B in the opposite rotation direction, as illustrated in FIG. 5A.

Figure 5B:
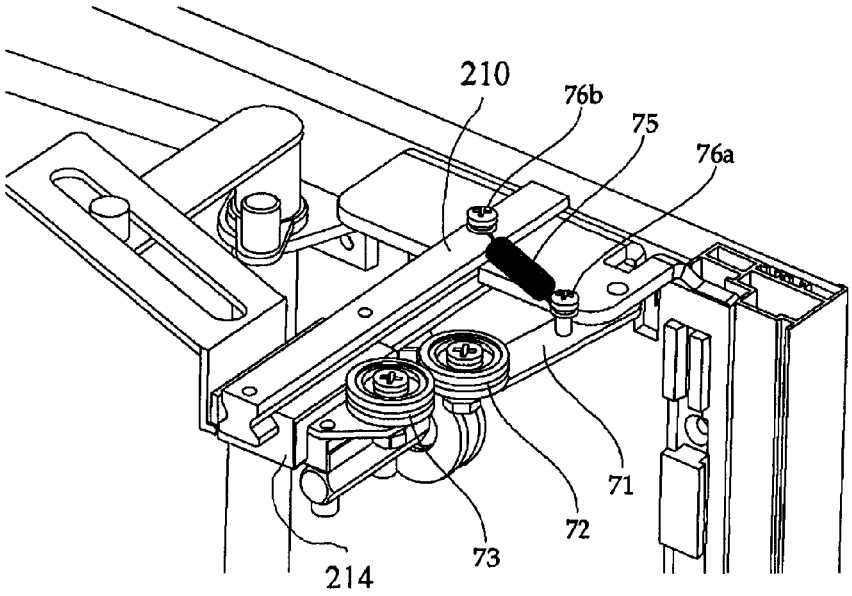
FIG. 5B schematically illustrates one ejection assembly of the system at an ejected position having the mode fixation assembly in the ejected position, according to embodiments of the present invention as illustrated in FIG. 4.
Figure 5C:
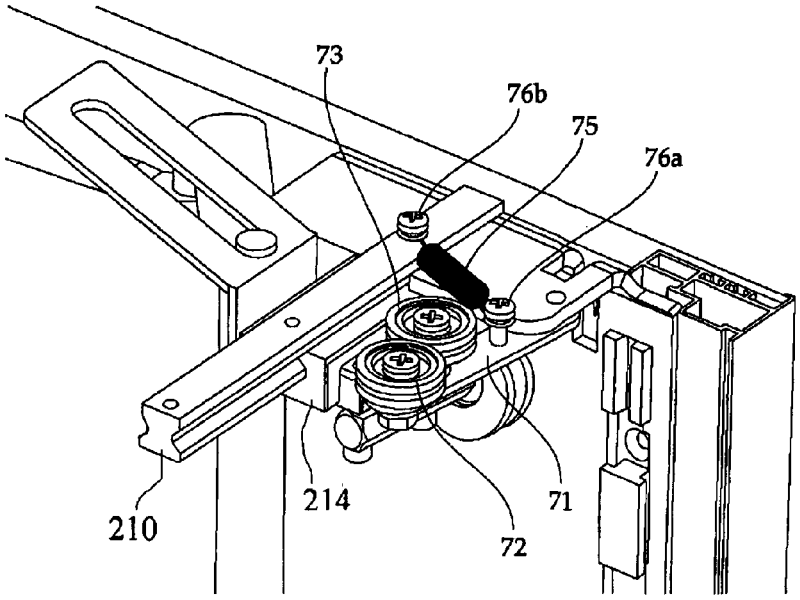
FIG. 5C schematically illustrates the ejection assembly of the system at a retracted position having the mode fixation assembly in the retracted position, according to embodiments of the present invention as illustrated in FIG. 4.

As illustrated in FIGS. 4, 5A, 5B and 5C, the system 600 additionally includes a mode fixation mechanism including mode fixation assemblies 70. Each mode fixation assembly 70 is installed at a different ejection assembly 200A-200D. According to some embodiments of the present invention, as illustrated in FIG. 5A and FIG. 5B, the mode fixation assembly 70 includes two sets of roller stoppers a first roller stopper 72, and a second roller stopper 73. The first roller stopper 72 pivotally connects to the rail 210 through a fastener 71 in a retractable manner, using a retractable member such as a spring 75, where the spring 75 connects to the rail 210 at one end and to the fastener 71 at the other end through attaching members such as screws 76*a* and 76*b*. The spring 75 allows keeping tension for retracting the first roller stopper 72 to a closed retrieved position. Once the door 500 is in an ejected position, as illustrated in FIG. 5B, in which the first roller stopper 72 does not interlock (is "unlocked) with the second roller stopper 73 there is tension in the spring 75 enabling automatic mechanical retraction to a closed retrieved position, in which the roller stoppers b72 and b73 interlock. The fastener 71 is retracted into the closed interlocking position upon applying a slight force for retrieving of the door 500. The fastener 71 is pivotally and retractably connected to the rail 210 to allow rotation thereof around the "y" axis for enabling the first roller stopper 72 to interlock and unlock with the second roller stopper 73. This allows the door 500 to be positioned in two positions only: the ejected and the retrieved positions preventing the door 500 from being in a middle position therebetween.

Figure 6:
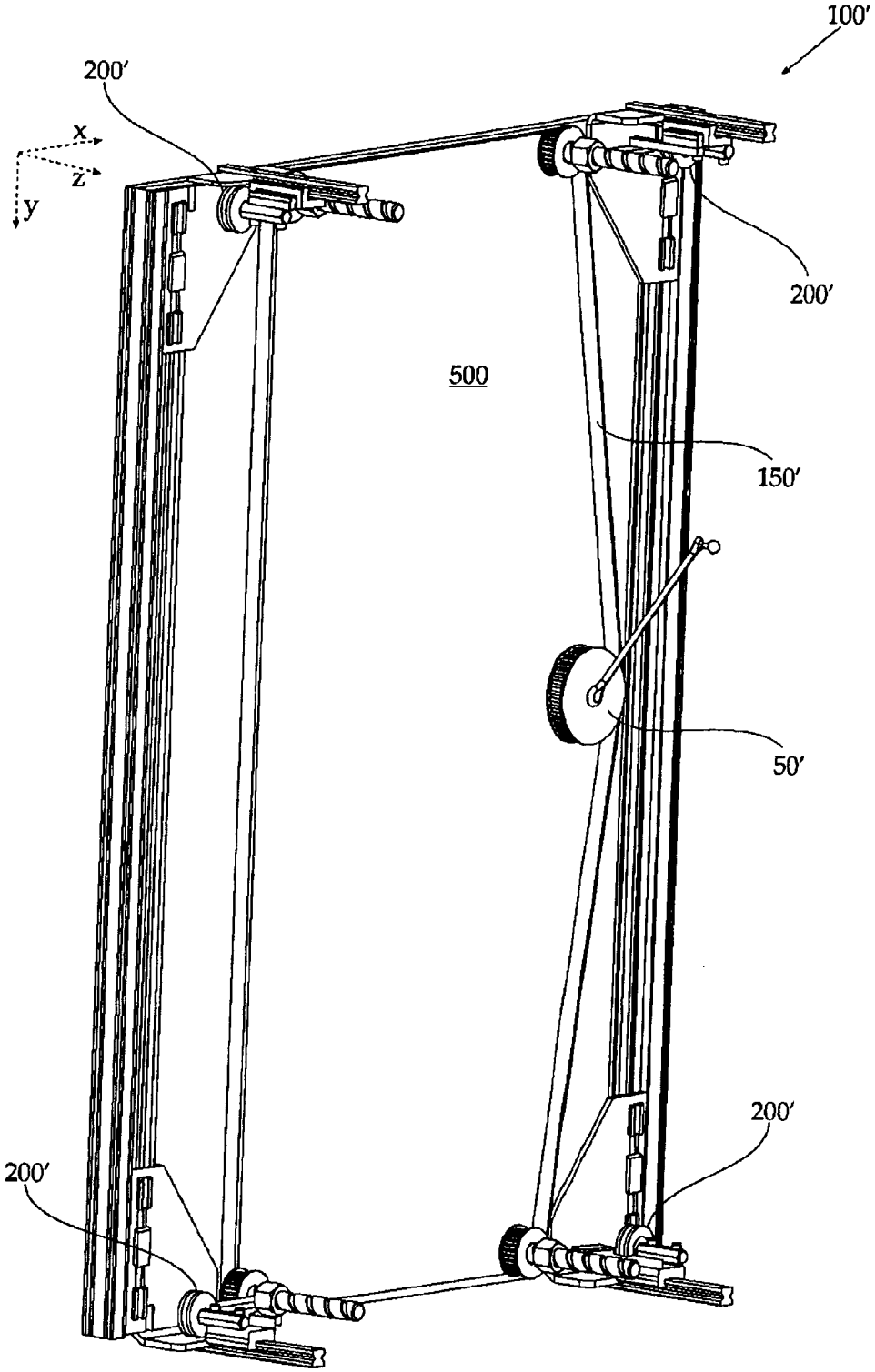
FIG. 6 is an isometric view of a system for ejecting a sliding door of a closet, having a strip connecting mechanism, according to other embodiments of the present invention.

Reference is now made to FIG. 6, which schematically illustrates an ejection system 100' for a sliding door 500, according to other embodiments of the present invention.

The ejection system 100' may include four ejection assemblies 200' and a connecting mechanism 150'. Each ejection assembly 200' including the same configuration of a connecting member 250', a sliding member 214' and a rail 210'. Each ejection assembly 200' may be installed at a different corner of the door 500 similarly to the installation described in FIGS. 1-3.

In these embodiments, the connecting mechanism 150' includes a strip, which may be made from elastic or non-elastic material such as rubber, fabric, etc. Each ejection assembly 200' includes a shaft 240, a fastening member 241, and a pulley 245.

The shaft 240 may be spirally furrowed serving as a male screw portion, where the fastening member 241 is a nut enabling to move along the shaft 240 by spirally screwing through it. Since the fastening member 241 is connected to the slidable member 214', it allows sliding the slidable member 214' once moved along the shaft 240.

Figure 7:
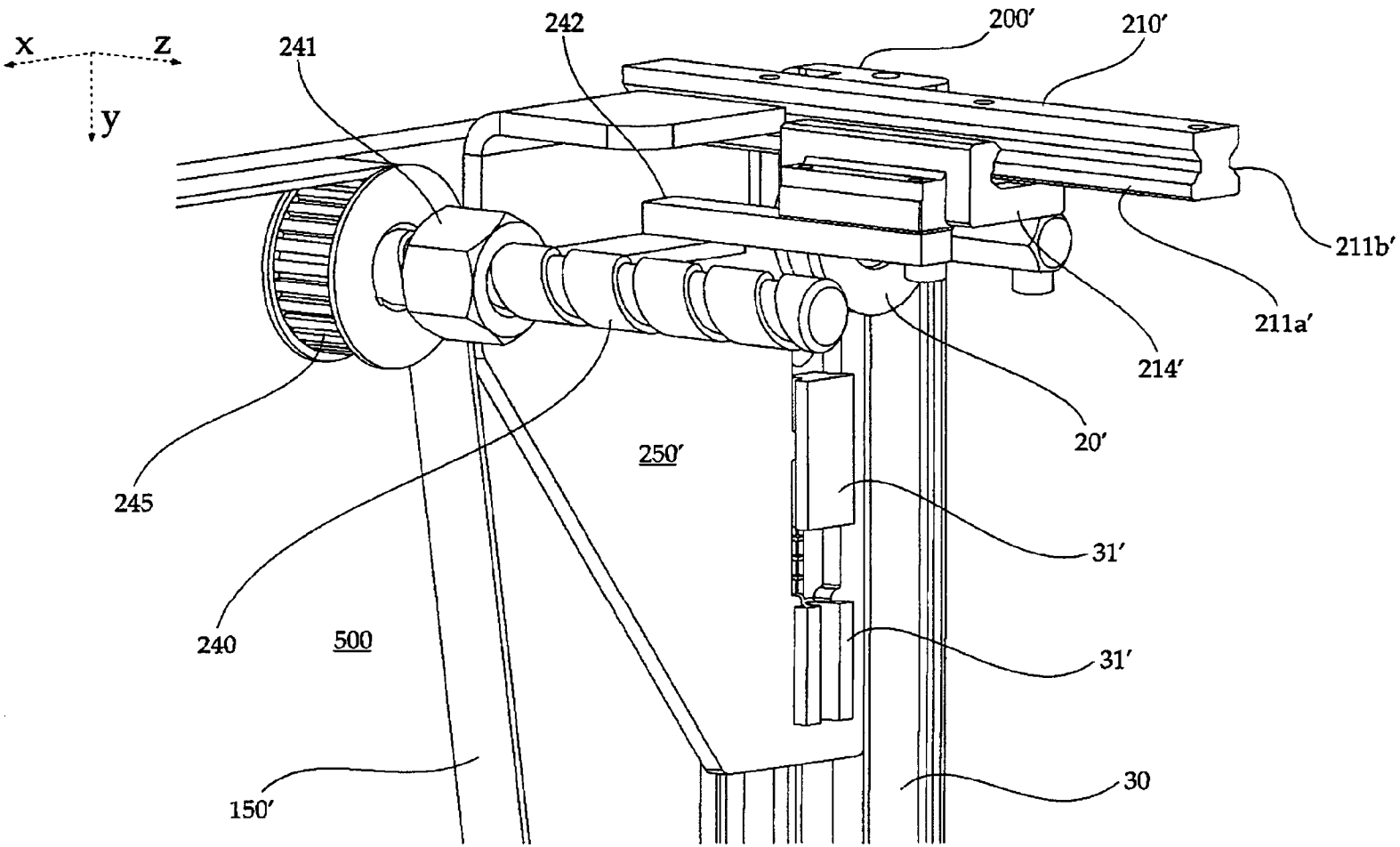
FIG. 7 schematically illustrates an ejection assembly of the system at a retrieved position installed at a sliding door, according to embodiments of the present invention as illustrated in FIG. 6.
Figure 8:
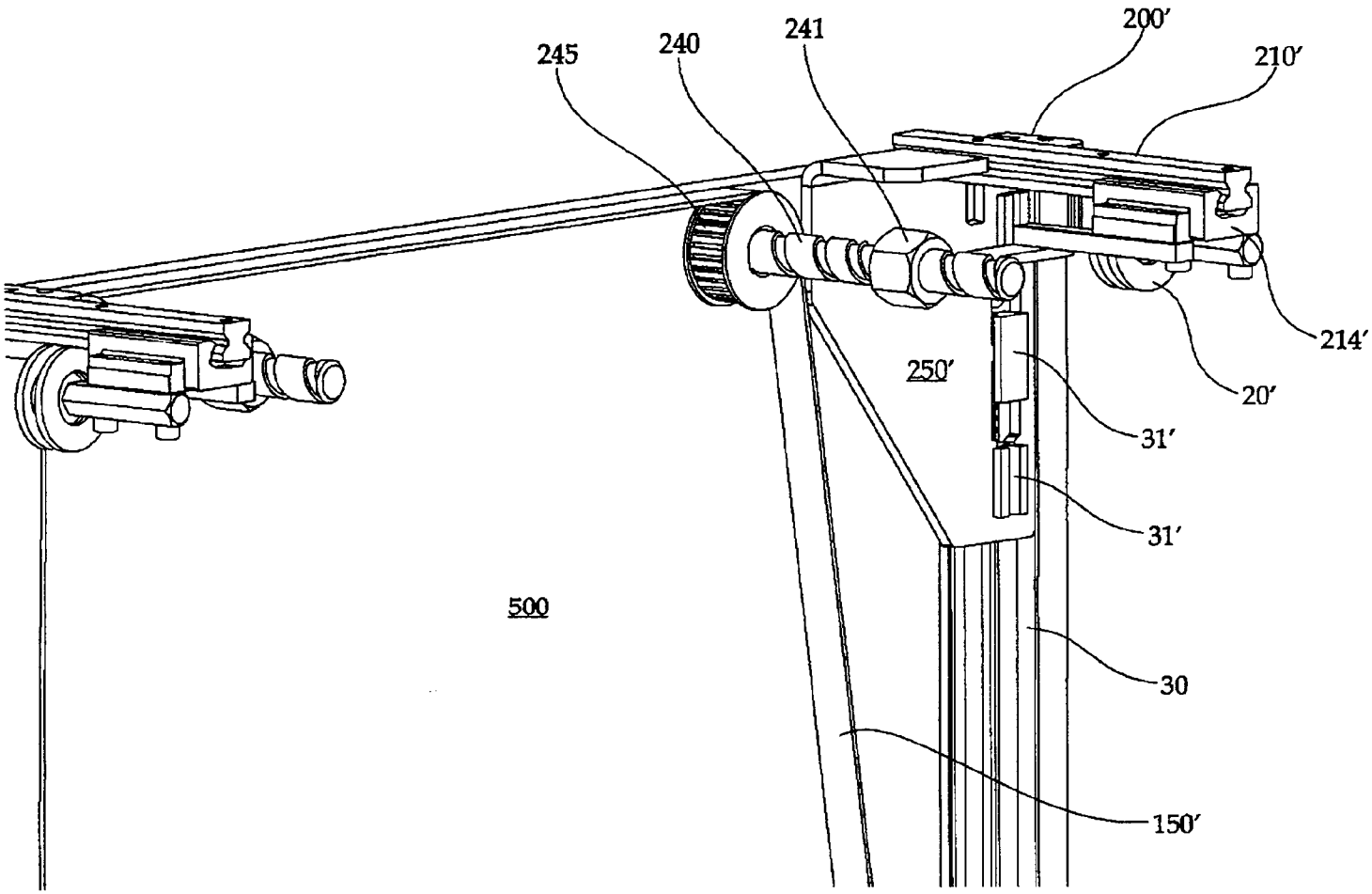
FIG. 8 schematically illustrates an ejection assembly of the system at an ejected position installed at a sliding door, according to embodiments of the present invention as illustrated in FIG. 6.

As illustrated in FIGS. 7-8 the pulley 245 engages with the strip 150' and allows rotating the shaft 240 upon movement of the strip 150', thereby allowing the fastening member 241 to move along the shaft 240 upon rotation thereof.

Figure 9:
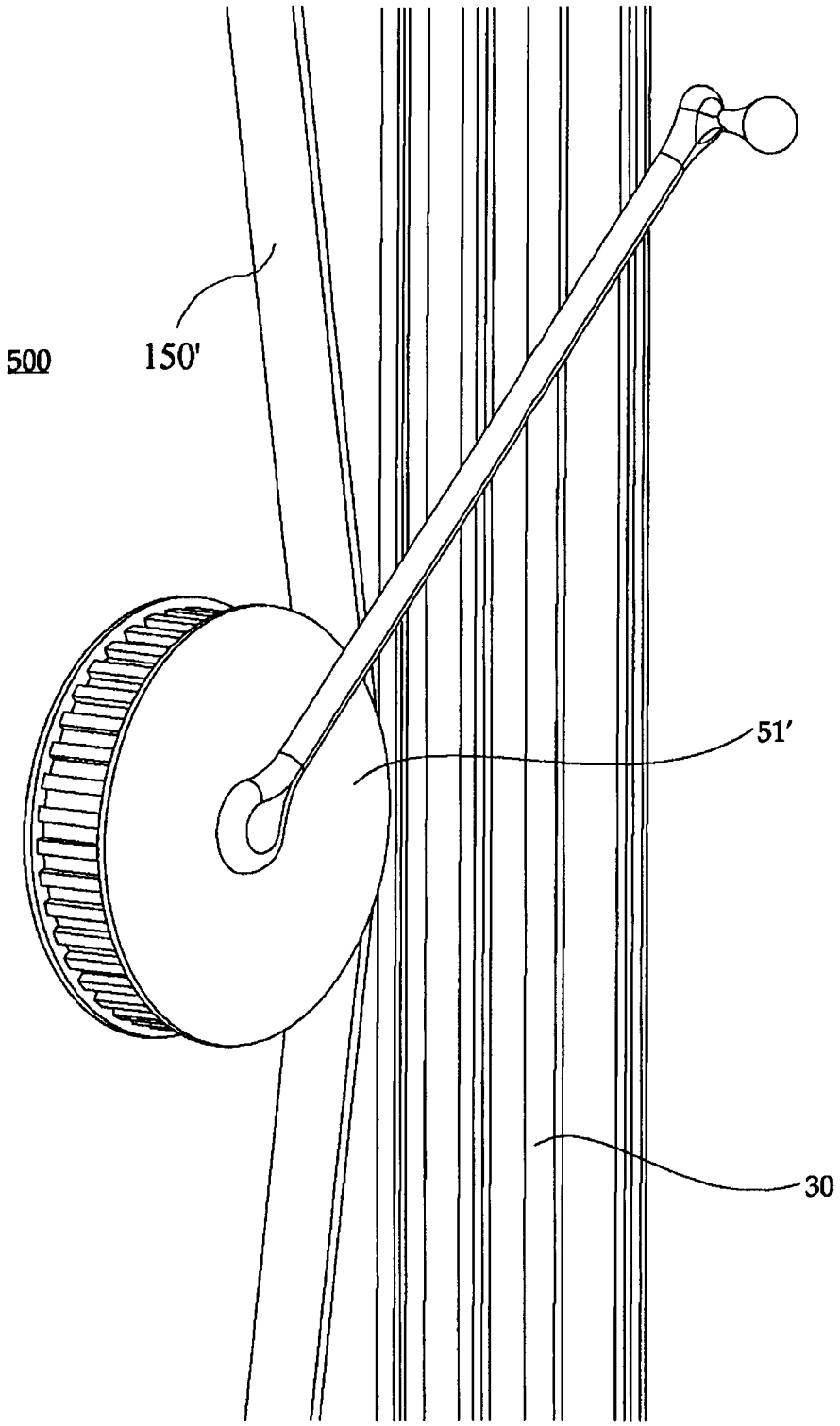
FIG. 9 schematically illustrates a handle pulley of the system, according to the embodiments illustrated in FIG. 6.

According to some embodiments of the present invention, as illustrated in FIG. 9, the strip 150' further engages a handle pulley 51' which allows rotation of the strip 150' upon rotation of a door handle connected thereto.

The connecting member 250' may be fastened to the profile 30 of the door 500 through protruding members 31' in a similar manner to that described in relation to FIGS. 1-3.

As illustrated in FIGS. 7-8, the ejection assembly 200' further includes a roller 20', configured to slide along a track of the closet along an axis "x". The roller 20' is fastened to the slidable member 214' through any fastening means known in the art. The rolling direction of the roller 20' along the door track is angular to the sliding direction of the slidable member 214' along the rail 210'. The sliding direction of the slidable member 214', as illustrated in FIGS. 7-8, is along an axis "z" perpendicular to "x" the sliding direction of the door 500. The fastening member 241 is also configured to move along the "z" axis.

Once the door 500 is in an ejected position, in which the door is moved outwardly, as illustrated in FIG. 8, the slidable member 214' is located at a distal end in relation to the door 500 and the fastening member 241 is located at a distal end in relation to the door 500. In a closed position, in which the door is retrieved inwardly, as illustrated in FIG. 7, the slidable member 214' is located at a proximal end in relation to the door 500 and the fastening member 241 is located at a proximal end in relation to the door 500.

Figure 10:
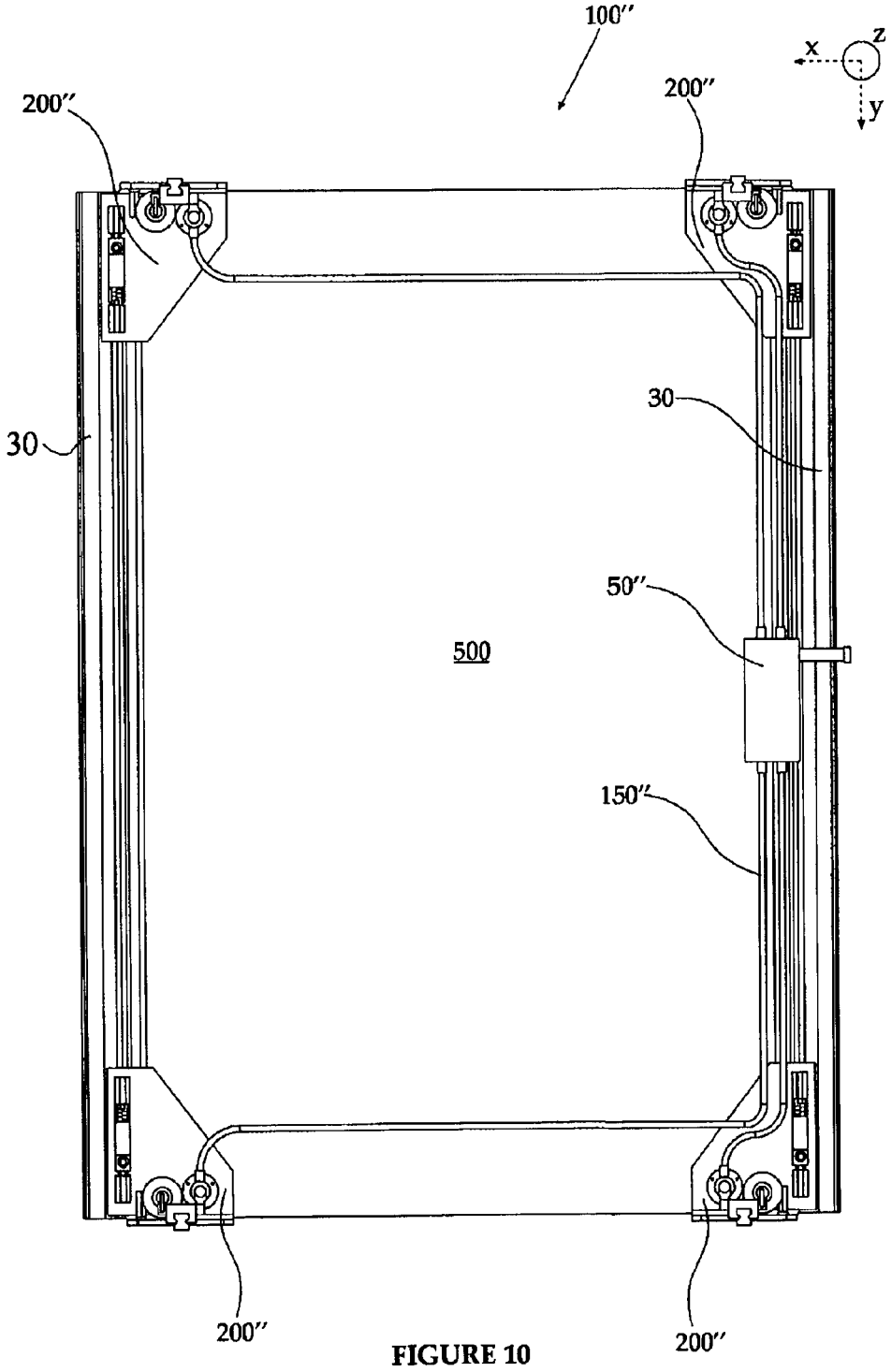
FIG. 10 is an isometric view of a system of ejecting a sliding door of a closet, having a hydraulic/pneumatic connecting mechanism, according to additional embodiments of the present invention.

Reference is now made to FIG. 10, which schematically illustrates an ejection system 100" for a sliding door 500, according to additional embodiments of the present invention.

The ejection system 100" may include four ejection assemblies 200" and a connecting mechanism 150". Each ejection assembly 200" including the same configuration of a connecting member 250", a sliding member 214" and a rail 210". Each ejection assembly 200" may be installed at a different corner of the door 500 similarly to the installation described in FIGS. 1-3.

In these embodiments, the connecting mechanism 150" includes a tube set operatively connected to a hydraulic/pneumatic pump 50" enabling to pump liquid/air through the tube set 150" to allow moving the slidable members 214" for ejecting and retrieving of the door 500.

Figure 11:
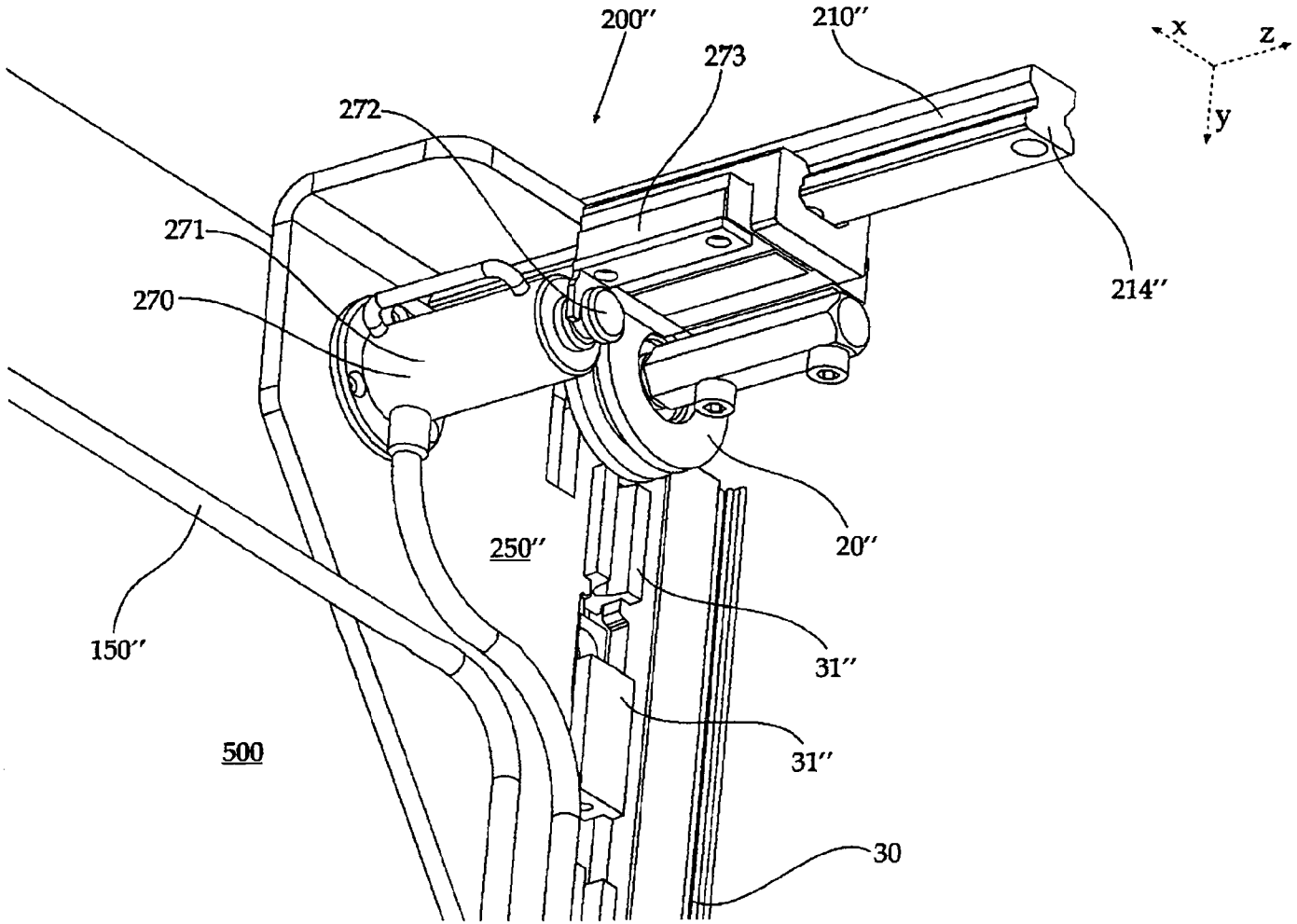
FIG. 11 schematically illustrates an ejection assembly of the system at a retrieved position installed at a sliding door, according to embodiments of the present invention as illustrated in FIG. 10.
Figure 12:
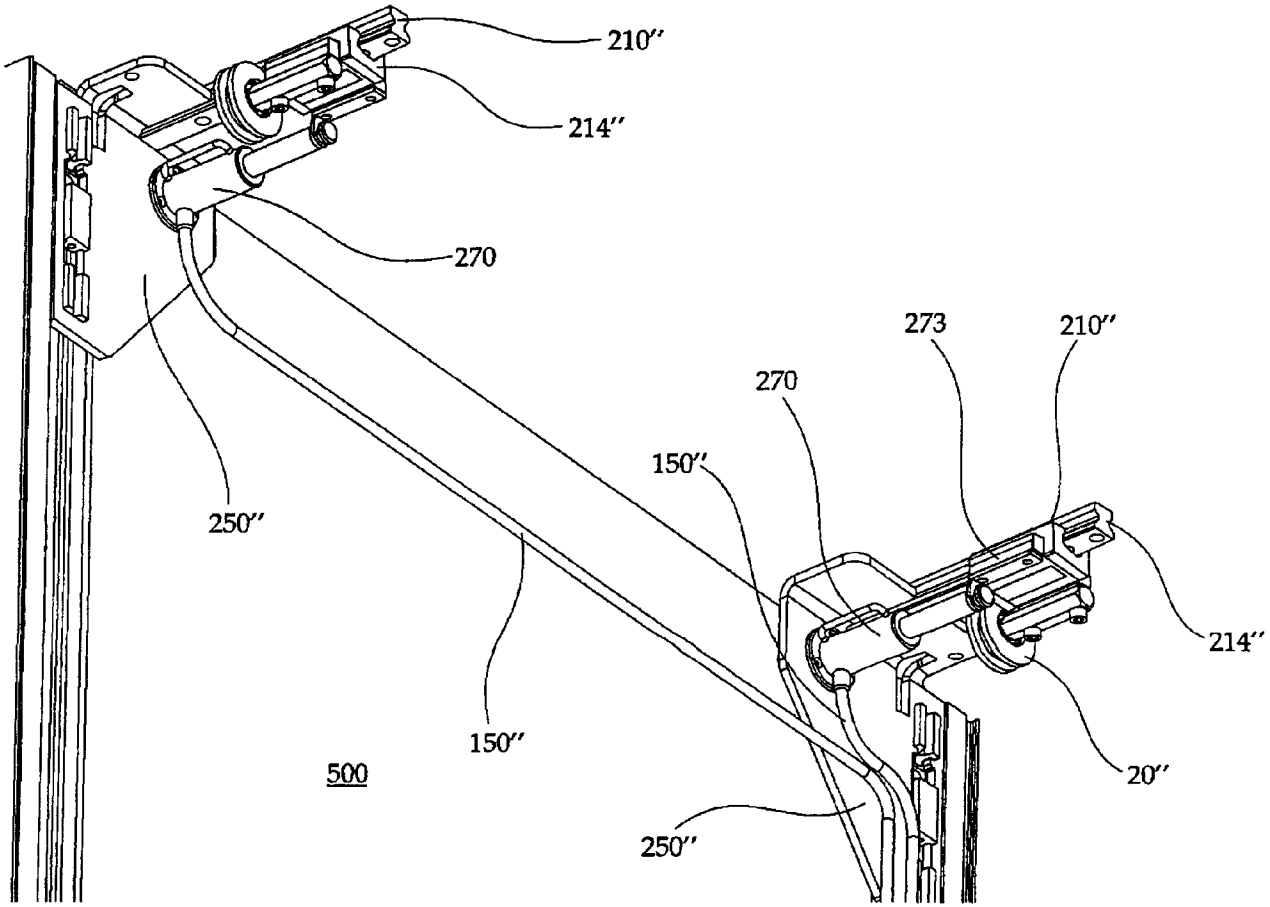
FIG. 12 schematically illustrates ejection assemblies of the system at an ejected position installed at a sliding door, according to embodiments of the present invention as illustrated in FIG. 10.
Figure 13:
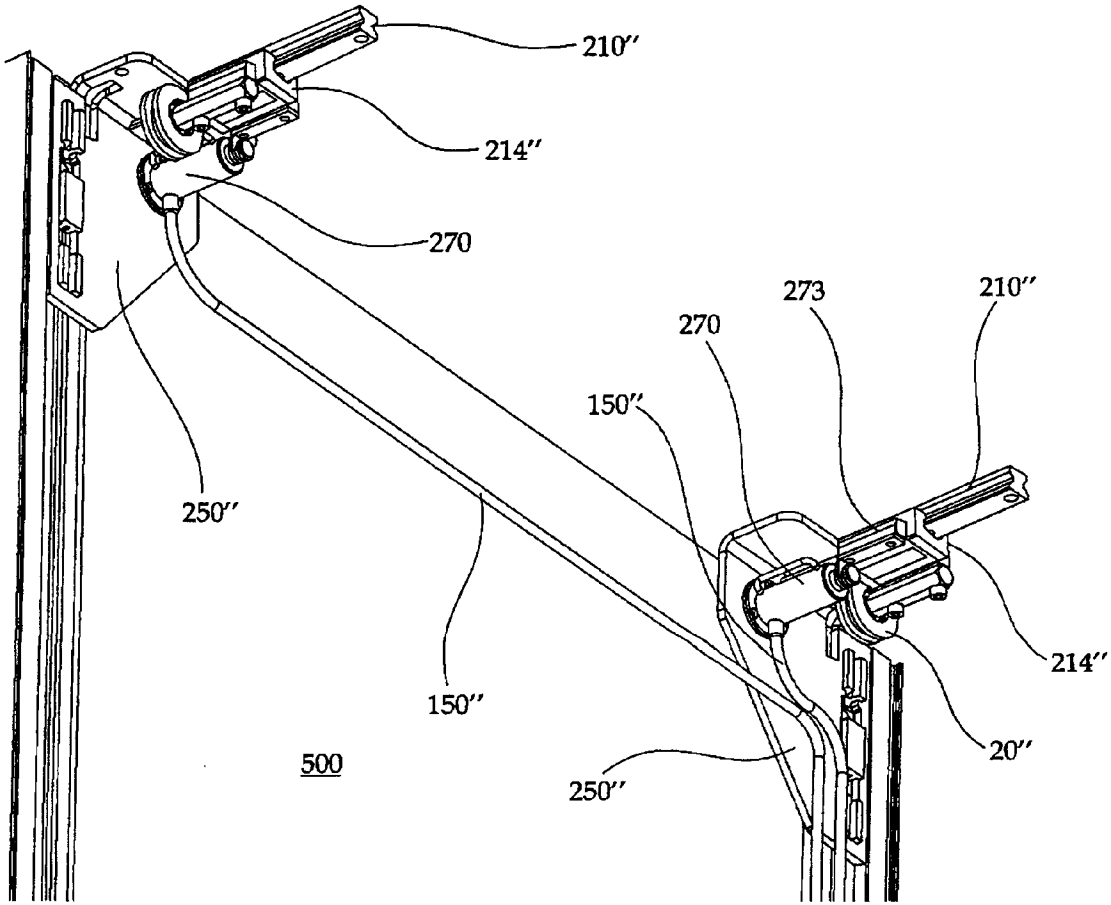
FIG. 13 schematically illustrates ejection assemblies of the system at a retrieved position installed at a sliding door, according to embodiments of the present invention as illustrated in FIG. 10.

As illustrated in FIGS. 11-13, each of the ejection assemblies 200" further includes a piston 270 including a cylindrical member 271 and a piston member 272 ejecting in and out of the cylindrical member 271. The cylindrical member 270 connects to the tube set 150" and the piston member 272 connects to the slidable member 214" enabling to move the slidable member 214" upon ejection in and out of the cylindrical member 272.

The piston member 272 may be moved in and out of the cylindrical member 271 along an axis "z" parallel to the sliding direction of slidable member 214" and perpendicular to the sliding direction "x" of the roller 20" along the track.

The pump 50" may be electronically operated using a control panel including operation input controllers such as operation buttons. The control panel may be installed at the door 500 or a remote panel.

The connecting member 250" may be fastened to the profile 30 of the door 500 through protruding members 31" in a similar manner to that described in relation to FIGS. 1-3.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A system for moving a sliding door of a closet outwardly and inwardly for pushing and pulling thereof, said system comprising:

(a) at least two ejection assemblies, each ejection assembly comprising:

a rail;

a slidable member configured to slide along said rail, wherein each rail engages a frame of said closet, and wherein each said ejection assembly is connectable to said door;

a connector, connecting to said slidable member at one end, said connector having a groove; and an interlocking member comprising a protrusion configured to movably interlock into said groove and slide along said groove for enabling said slidable member to move along said rail, and (b) a connecting mechanism connecting said at least two ejection assemblies to one another such as to allow synchronized operation of the ejection assemblies, wherein each of said ejection assemblies enables moving said door outwardly and inwardly wherein the rails simultaneously move in relation to each of said slidable members, for applying a force upon said sliding door that is perpendicular to a plane of the sliding door, at a plurality of locations in a synchronized manner, and wherein said rails are positioned perpendicular to said door such as to have the sliding door move perpendicularly to a plane thereof throughout the outward or inward movement of the sliding door.

2. The system of claim 1, wherein said connecting mechanism, which connects said ejection assemblies to one another, is further connected to said door via at least one bracket.

3. The system of claim 1, wherein each said connecting mechanism comprises at least one rod each rod connecting one ejection assembly to another.

4. The system of claim 3, wherein said system comprises four ejection assemblies, each installed at a different corner of said door, and wherein each said connecting mechanism comprises:

a first rod connecting two ejection assemblies located at two corners at a first side of said door;

a second rod connecting two other ejection assemblies located at two corners at a second side of said door; and a rod-connecting assembly for connecting said first rod to said second rod.

5. The system of claim 4, wherein said rod-connecting assembly comprises a first connector, a second connector, a third connector and a main axle, wherein said first connector pivotally connects to said main axle at one end ant to said door at another end, said second connector pivotally connects to said main axle at one end and to said first rod at another end, and said third connector pivotally connects to said main axle at one end and to said second rod at another end.

6. The system of claim 5, wherein said main axle further connects to said door.

7. The system of claim 6, wherein said first connector connects to a handle of said door thereby allowing manual movement of said door inwardly and outwardly by rotation of said handle.

8. The system of claim 1, further comprising a control panel and at least one motor, operatively associated with at least one of said ejection assemblies for allowing the user to control the movement of the door inwardly and outwardly.

9. The system of claim 1, wherein said connecting mechanism comprises a strip enabling to movably connect to each of said ejection assemblies, wherein each said ejection assembly further comprises a rotatable assembly comprising:

a shaft;

a fastening member; and a pulley, wherein said pulley engages with said strip and allows rotating said shaft upon movement of said strip, and said fastening member enables moving along said shaft upon rotation thereof, and wherein said fastening member further connects to said slidable member thereby allowing sliding thereof along the rail upon moving of the fastening member along said shaft.

10. The system of claim 9, wherein said strip further engages a handle pulley which allows rotation of the strip upon rotation of a handle connected thereto.

11. The system of claim 1, further comprising a hydraulic pump, wherein said connecting mechanism includes a tube set enabling to direct liquid that is pumped by said hydraulic pump therethrough, wherein each of said ejection assemblies further comprises a piston including a cylindrical member and a piston member moving in and out of said cylindrical member, said cylindrical member connects to said tube set and said piston member connects to the slidable member enabling to move said slidable member upon in and out movement of said cylindrical member.

12. The system of claim 11, wherein said pump is electronically operated.

13. The system of claim 1, further comprising a pneumatic pump, wherein said connecting mechanism includes a tube set enabling to direct air that is pumped by said pneumatic pump therethrough, wherein each of said ejection assemblies further comprises a piston including a cylindrical member and a piston member moving in and out of said cylindrical member, said cylindrical member connects to said tube set and said piston member connects to the slidable member enabling to move said slidable member upon in and out movement of said cylindrical member.

14. The system of claim 13, wherein said pump is electronically operated.

15. The system of claim 1, wherein each ejection assembly is further connected to a mode fixation assembly, said mode fixation assembly comprises a first stopper and a second stopper, said stoppers interlock when the door is in a retrieved position and unlocked when the door is in an ejected position, thereby enabling the door to be positioned in one of two positions: a fully retrieved position, in which said stoppers interlock, and fully ejected position, in which said stoppers are unlocked.

16. The system of claim 15, where said first stopper is pivotally connected to said rail through a retractable member allowing automatic mechanical retraction of said first stopper to a retrieved position, in which said first roller interlocks said second stopper.

17. The system of claim 1, wherein said system comprises four ejection assemblies, each installed at a different corner of said door, and wherein each said connecting mechanism comprises:

a first rod connecting two ejection assemblies located at two corners at a first side of said door;

a second rod pivotally connecting two other ejection assemblies located at two corners at a second side of said door; and a connector for pivotally connecting to said first rod and second rod, said connector further pivotally connects to a proximal part of one ejection assembly at one end thereof and to a distal part of another ejection assembly at another end thereof, thereby positioned at an angle in relation to the door plane, thereby enabling to rotate one rod in one rotation direction while simultaneously rotating the other rod in an opposite rotation direction.

18. A system for moving a sliding door of a closet outwardly and inwardly for pushing and pulling thereof, said system comprising:

at least two ejection assemblies, comprising a rail and a slidable member configured to slide in a sliding direction along said rail, wherein each rail engages a frame of said closet, and wherein each said ejection assembly is connectable to said door; and a connecting mechanism connecting said at least two ejection assemblies to one another such as to allow synchronized operation thereof, wherein each of said ejection assemblies enables moving said door outwardly and inwardly wherein the rails simultaneously move in relation to each of said slidable members, for applying a force upon said door at a plurality of locations in a synchronized manner wherein each of said ejection assemblies further comprises:

a connector, connecting to said slidable member at one end, said connector includes a groove;

an interlocking member including a protrusion configured to movably interlock into said groove of said connector, wherein said movable member is further operatively connected to said connecting mechanism;

at least one second connecting member is configured to allow connecting said ejection assembly to said door; and a roller, configured to slide along a track of said closet, wherein rolling direction of said roller along said track is angular to sliding direction of said slidable member along said rail;

wherein said protrusion of said interlocking member is movably inserted through said groove and configured to slide along said groove, thereby enabling said slidable member to move along said rail.

19. The system of claim 18, wherein said door is attached to a profile framing the door at each side, and wherein said second connecting member connects ejection assembly to said door by connecting to said profile.

* * * * *